United States Patent [19]

Cherrington

[11] 4,091,631

[45] May 30, 1978

[54] SYSTEM AND METHOD FOR INSTALLING PRODUCTION CASINGS

[75] Inventor: Martin Dee Cherrington, Carmichael, Calif.

[73] Assignee: Titan Contractors Corporation, Sacramento, Calif.

[21] Appl. No.: 717,827

[22] Filed: Aug. 26, 1976

Related U.S. Application Data

[63] Continuation-in-part of Ser. No. 595,830, July 14, 1975, Pat. No. 4,043,136.

[51] Int. Cl.[2] ..... F16L 1/02

[52] U.S. Cl. ..... 61/72.7; 175/62

[58] Field of Search ..... 61/72.4, 72.7, 42, 84, 61/85, 105; 175/69, 62, 70, 173, 215, 323

[56] References Cited

U.S. PATENT DOCUMENTS

| | | | |
|---|---|---|---|
| 3,419,092 | 12/1968 | Elenburg | 175/69 |
| 3,635,036 | 1/1972 | Hooper | 61/72.7 X |
| 3,674,100 | 7/1972 | Becker | 175/69 |
| 3,894,402 | 7/1975 | Cherrington | 61/72.4 |

*Primary Examiner*—Paul R. Gilliam
*Assistant Examiner*—David H. Corbin
*Attorney, Agent, or Firm*—Townsend and Townsend

[57] ABSTRACT

A system and method for emplacing a relatively large casing under and spanning an obstacle such as a river is disclosed. The casing is emplaced along the arcuate path of a previously bored and placed existing pilot string running beneath the obstacle between positions near ground level on opposite sides of the obstacle. A seal is provided between the outer surface of the leading portion of the casing and the reamed pilot hole so that the drilling mud containing the entrained cuttings flows into the leading end of the advancing casing. In one preferred embodiment a washover pipe circumscribing the pilot string serves the dual function of rotating a case-leading reamer and driving a positive displacement pump-typically of the moineau variety-to evacuate drilling fluid and entrained cuttings. This evacuation can occur through the drill string. The production casing in this embodiment can be used to communicate a high lubricity fluid to the advancing and non-rotating production casing to ease the pressure required to crowd the production casing in the path of the reamer. Drilling mud flowing into the leading end of the casing is impelled, typically by an auger, toward the trailing end of the casing to remove the drilling mud from the reamed pilot hole and prevent the cuttings from settling in an annulus circumscribing the casing.

3 Claims, 5 Drawing Figures

SYSTEM AND METHOD FOR INSTALLING PRODUCTION CASINGS

This is a continuation-in-part of my co-pending patent application, Ser. No. 595,830, filed July 14, 1975, now U.S. Pat. No. 4,043,136 entitled SYSTEM AND METHOD FOR INSTALLING PRODUCTION CASINGS.

FIELD OF THE INVENTION

The present invention relates to a system and method for emplacing a casing under a surface obstacle such as a river, and in particular to such a system and method wherein all cuttings are removed from the hole to prevent freezing of the production casing as it is being installed.

DESCRIPTION OF THE PRIOR AND CONTEMPORANEOUS ART

Techniques have recently been developed for installing relatively large diameter casings beneath rivers and other surface obstacles without dredging the riverbed or otherwise altering the obstacle itself. Instead, a pilot hole is first drilled from a position at or near the surface on one side of the obstacle to a position at or near ground level on the other side. See my U.S. Pat. No. 3,878,903 entitled APPARATUS AND METHOD FOR DRILLING UNDERGROUND ARCUATE PATHS issued Apr. 22, 1975. After drilling the pilot hole, the pilot drill string used to drill the pilot hole remains in the hole. A reamer is then attached to one end of the drill string and is drawn or forced through the pilot hole about the pilot string to ream the pilot hole to a preselected larger diameter. The production casing or other large diameter casing moves into the reamed annulus about the pilot string in the pilot hole in following relationship to the reaming apparatus. As a result, when the pilot hole has been reamed from one end to the other, the larger casing occupies the reamed hole.

In the recently developed techniques discussed above for installing casings along the path of a pilot hole, the cuttings from the reamer are entrained in drilling mud. The reamed pilot hole has a slightly greater diameter than the outer diameter of the casing, and the drilling mud containing the entrained cuttings flows out of the hole through the annular space circumscribing the casing. It has been found that as long as the drilling mud containing the entrained cuttings flows along the casing, the casing will move smoothly into the hole because the flowing drilling mud greatly reduces friction between the casing and the sides of the reamed pilot hole.

The above method of placing large diameter casings beneath surface obstacles has proved to be quite effective when relatively short distances are to be traversed. However, where large crossings must be made, such as under a river which can be up to one mile wide, the above techniques have proved to be ineffective. As the large casing is being advanced into the ground, the pressure at which the drilling mud must be forced into the hole so that it will flow along the outside of the large casing increases. In relatively soft ground such as a riverbed, the drilling mud at such higher pressures acts to hollow out the reamed pilot hole, greatly increasing the volumetric rate of flow of the drilling mud required to maintain a continuous flow of such mud into the out of the of reamed hole. As the distance along which the large casing has been advanced increases, the volumetric rate of flow and the pressure required to maintain continuous flow increase in a nonlinear fashion because of the hollowing out of the hole. Eventually, either the capacity of the pumps injecting the drilling mud into the hole is exceeded or the hole blows out through soil strata near its leading end, and the continuous flow of the drilling mud out of the hole along the outside of the large casing ceases.

When the flow of drilling mud along the outer surface of the large casing stops, the cuttings will remain in the hole and accumulate. The stationary cuttings will thus surround the casing as it is being advanced into the hole, and the lubricity of the fluid is lost. The friction on the casing will increase dramatically and typically freeze the casing in the hole. Once movement of the casing stops, static friction must be overcome to further advance the casing, which is larger than dynamic friction and the casing ordinarily cannot be moved and remains in the hole.

SUMMARY OF THE INVENTION

The present invention provides a system and method for emplacing a relatively large casing under and spanning an obstacle such as a river. The casing is emplaced along the path of an existing pilot string running beneath the obstacle. The pilot string extends in an inverted arcuate path from a first position at or near ground level on one side of the obstacle to a second position at or near ground level on the other side of the obstacle. The system includes apparatus for reaming an annulus concentrically about the pilot string to a preselected diameter and entraining the cuttings from the reaming operation in a slurry of transport fluid such as drilling mud present at the site of reaming. The casing is advances along the reamed pilot hole in following relationship to the reaming apparatus. A seal is provided between the outer surface of the leading portion of the casing and the reamed pilot hole so that the drilling mud containing the entrained cuttings flows into the leading end of the advancing casing. In one preferred embodiment a washover pipe circumscribing the pilot string serves the dual function of rotating the reamer and driving a positive displacement pump—typically of the moineau variety—to evacuate drilling fluid with entrained tubings. This evacuation can occur through the drill string. The production casing in this embodiment can be used to communicate a high lubricity fluid to the advancing and non-rotating production casing to ease the pressure required to crowd the production casing in the path of the reamer. The drilling mud flowing into the leading end of the casing is impelled typically by an auger, toward the trailing end of the casing to remove the drilling mud from the reamed pilot hole and prevent the cuttings from settling in an annulus circumscribing the casing.

In the system of the present invention, the drilling mud with the entrained cuttings does not flow along the outer surface of the casing as with existing systems. Instead, the drilling mud is confined within the casing itself so that it cannot hollow out the hole. Hollowing out of the hole had resulted in nonlinear increases in the pressure and volumetric flow required to maintain continuous flow of the drilling mud in the past, but is avoided with the present invention. Substantially all of the cuttings are removed from the hole as the drilling mud passes out of the hole through the interior of the casing. Because the drilling mud flows through the interior of the casing rather than around the outside of the casing, the flow will be continuous. The cuttings cannot become trapped in the space surrounding the casing to freeze the casing in place and prevent further movement thereof, a common occurrence in prior systems.

The drilling mud containing the entrained cuttings is forced along the interior of the casing by impelling apparatus located within the casing near the leading end thereof. In the preferred embodiment of the present invention, the impelling means comprises an auger extending at least part way from the leading end of the casing to the trailing end. In addition, suction can be provided at the trailing end of the casing. Both the impelling apparatus and the suction apparatus facilitate the continuous cycling of drilling mud into and out of the hole to insure that all cuttings are removed therefrom.

When the system of the present invention is used, ground water will ordinarily fill any space which remains in the reamed pilot hole circumscribing the casing. Such ground water will provide natural flotation and lubrication of the casing. In addition, if desired, a lubricating fluid can be injected into this space to further facilitate the advancing of the casing into the hole.

In the preferred embodiment of the present invention, the pilot drill string used in drilling the pilot hole remains in the hole. A washover pipe is advanced into and along the path of the pilot hole from one side of the obstacle circumscribing the pilot string. The pilot string remains in place and need not be dismantled as the washover pipe is being advanced. The reaming apparatus is located at the leading end of the washover pipe, and the washover pipe is rotated as it is advanced into the hole to ream the hole to a larger diameter. The drilling mud is injected into the hole through the annular space between the pilot string and the washover pipe and exits at the reaming apparatus. The auger is attached to the outer circumference of the washover pipe and impells the drilling mud containing the cuttings from the reaming apparatus toward the trailing end of the production casing.

In another preferred embodiment, the washover pipe both rotates the auger flight and powers an in-hole positive displacement pump. This pump evacuates drilling fluid—such as mud—together with entrained tailings under positive pressure. Typically such evacuation can preferably occur through a swivel connection interior of the pilot string and out the pilot string. Thus a reamer can be placed to rotate in front of a non-rotating larger production casing.

It should be understood that large diameter production casings—because of their increased diameters—cannot be rotated over small radii of curvature. Typically, they fail and break or shear. The feature of causing the reamer to rotate in front of a non-rotating production casing allows the production casing to be prebent and advanced without rotation. Installation of a production casing along a sharp radius of curvature can occur.

It is contemplated that relatively strong transverse forces will be exerted by the auger on the leading end of the casing. The path of the pilot hole is arcuate and transverse forces will be exerted on the leading end of the auger and transmitted to the casing as it attempts to follow this arcuate path. Accordingly, it is preferred that a section of larger diameter, thick walled pipe be interposed in the washover pipe at the leading end of the auger. Additionally, a relatively thick auger section should be used at its leading end so that the edges of the auger provide a bearing surface which acts against the inside walls of the leading end of the production casing. In this manner, the system of the present invention will be capable of withstanding the large transverse forces exerted on the leading end of the auger and transmitted to the production casing.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood however, that the drawings are for the purpose of illustration and description only and are not intended as a definition of the limits of the invention.

DESCRIPTION OF THE PREFERRED EMBODIMENT

General Description

Figure 1:
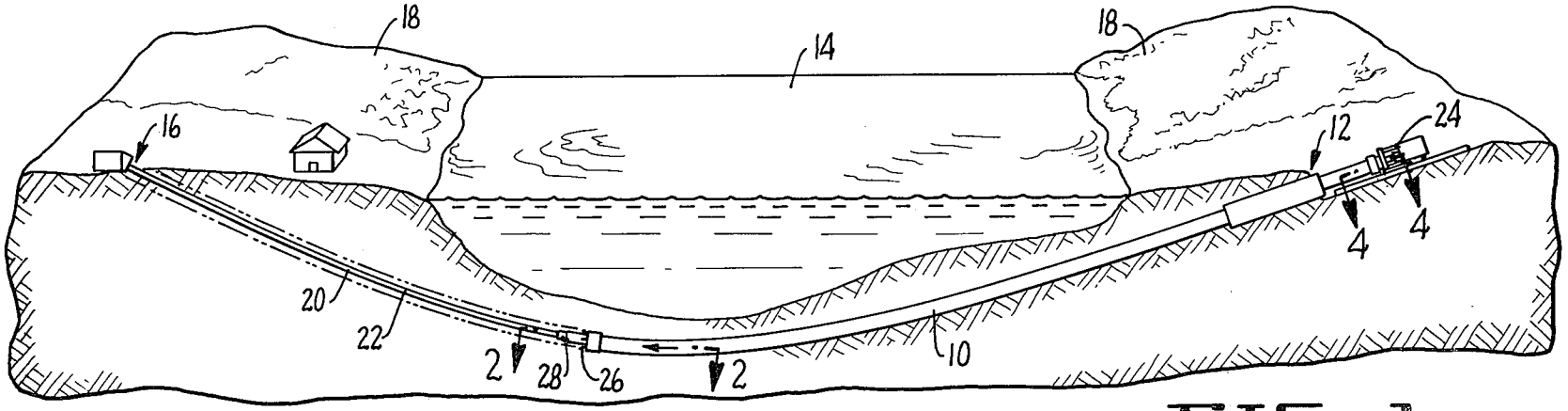
FIG. 1 is a perspective view of the installation of a production casing according to the teachings of the present invention.

The present invention provides a method for implacing a production casing 10 along an inverted underground arcuate path, as illustrated in FIG. 1. The path extends from a first position 12 on one side of a surface obstacle such as a river 14 to a second position 16 on the other side of the obstacle. Positions 12 and 16 are at or near the surface of the ground 18 surrounding river 14, and thus it is necessary that the path have an inverted arcuate shape as illustrated.

The present invention applies to drilling techniques wherein a pilot hole 20 is initially drilled along the chosen inverted underground arcuate path from the first position 12 on one side of river 14 to a second position 16 at the other side. Such techniques are demonstrated in my U.S. Pat. No. 3,878,903 issued Apr. 22, 1975, for APPARATUS AND PROCESS FOR DRILLING UNDERGROUND ARCUATE PATHS. The pilot hole is drilled using a drill bit having a trailing drill string 22 which occupies the pilot hole from one end to the other after the pilot hole has been completed.

In the system and method of the present invention, production casing 10 is advanced into and along the path of pilot hole 20 by a rig 24 located at the first position 12 on one side of river 14. As described in more detail hereinbelow, production casing 10 is advanced in following relationship to a reamer 26. Reamer 26 is mounted to the outer circumference of a washover pipe 28 which is advanced along the path of pilot hole 20 circumscribing pilot drill string 22. The cuttings from reamer 28 are entrained in drilling mud which is forced through the interior of casing 12 and out of the hole.

Detailed Description

Figure 2:
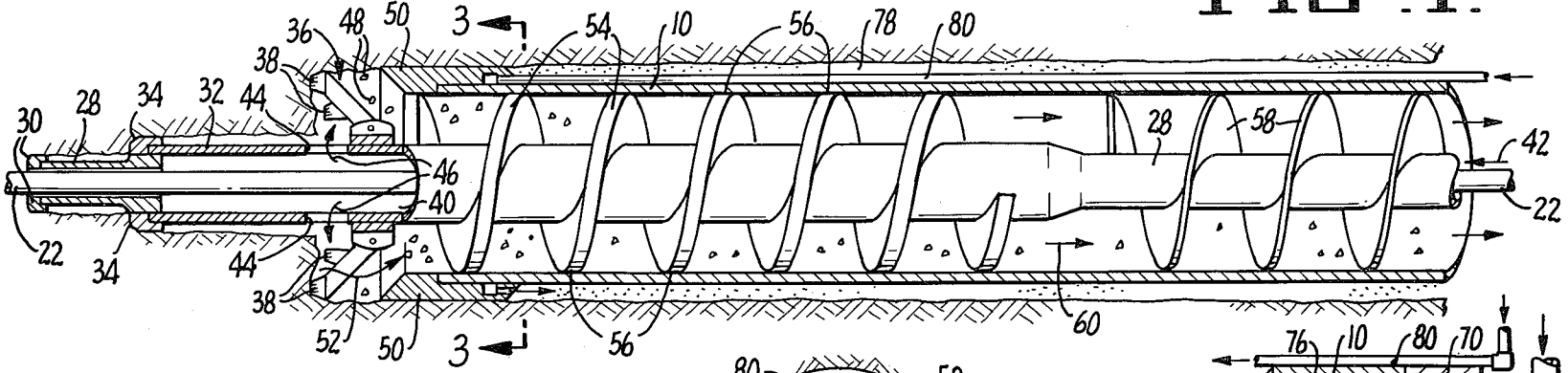
FIG. 2 is a sectional view taken along lines 2—2 of FIG. 1.

The system of the present invention is illustrated in more detail by way of reference to FIG. 2. Washover pipe 28 is provided with a plurality of teeth 30 at its leading end to open a path for the washover pipe as it is advanced along the path of the pilot hole around pilot drill string 22. A larger diameter, thick walled section 32 is interposed in washover pipe 28. A plurality of cutting teeth 34 are located at the leading end of large diameter section 32 to expand the hole to accommodate the width of the larger diameter section. Large diameter section 32 is followed by the remainder of the relatively smaller diameter washover pipe 28.

A reaming apparatus 36 having a plurality of flipout teeth 38 is mounted to washover pipe 28 along the outer circumference of larger diameter section 32. As washover pipe 28 is being advanced into and along pilot string 22, it is rotated by rig 24 (see FIG. 1) so that reamer teeth 38 ream the pilot hole to a larger diameter to accommodate production casing 10.

Figure 4:
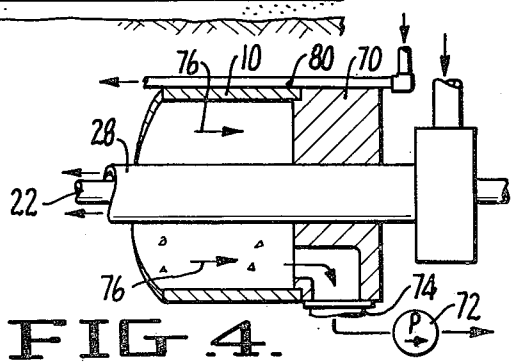
FIG. 4 is a sectional view taken along lines 4—4 of FIG. 1.

As washover pipe 28 is being advanced and rotated to operate reaming apparatus 36, drilling mud is injected through the annular space 40 between pilot string 22 and washover pipe 28, as illustrated by arrow 42. The drilling mud is pumped into annular space 40 through a conduit 43 at the trailing end of washover pipe 28, as illustrated in FIG. 4. One or more apertures 44 are provided in washover pipe 28 adjacent reaming apparatus 36. The drilling mud injected through the annular space between washover pipe 28 and drill string 22 exits through apertures 44 proximate reamer 36, as illustrated by arrows 46. The cuttings 48 from reaming apparatus 36 are entrained in the drilling mud.

Production casing 10 is advanced into and along the inverted arcuate path of pilot hole 20 by rig 24, as illustrated in FIG. 1. It is preferred that production casing 10 be advanced nonrotatably into the ground, particularly when large diameter casings are used, to minimize stress caused by rotating the casing when it has an arcuate configuration. Casings with built in curvature may be used which cannot be rotated. However, it may be desirable in some circumstances to advance the production casing rotatably into the ground. In any such situation, production casing 10 is advanced so that the leading end thereof follows immediately behind reaming apparatus 36.

Figure 3:
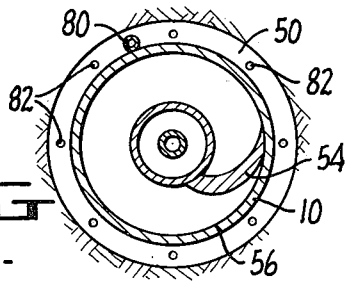
FIG. 3 is a sectional view taken along lines 3—3 of FIG. 2.

A pack-off blade 50 is mounted to the leading end of production casing 10 (see FIG. 2). Pack-off blade 50 circumscribes the leading end of the production casing and provides a sealing contact between the outer surfaces of the reamed pilot hole and production casing 10, as also illustrated in FIG. 3. Because of this sealing contact, the drilling mud containing the entrained cuttings from reamer 36 will pass into the leading end of the production casing as illustrated by arrow 52. Passage of the drilling mud containing the entrained cuttings into any annular space between the outer surface of production casing 10 and the inner surface of the reamed pilot hole is substantially prevented.

A relatively heavy auger flight 54 is mounted to the outer circumference of the large diameter segment 32 of washover pipe 28 immediately behind reaming apparatus 36. The blade portion of auger 54 has a relatively thick transverse dimension and provides a flat bearing surface 56 at its outer edges. Since pilot drill string 22 follows an arcuate path, relatively large transverse loads will be imposed by leading auger flight 54 against the interior walls of production casing 10. Accordingly, auger flight 54 with its wide bearing surfaces 56 is provided to withstand such transverse loads. In addition, auger flight 54 is mounted to the relatively larger diameter segment 32 of washover pipe 28 so that such transverse loads do not cause failure of the washover pipe.

Leading auger flight 54 impells the drilling mud containing the entrained cuttings 48 from reaming apparatus 36 from the leading end of production casing 10 toward the trailing end. Additional auger flights such as 58 may be mounted to washover casing 28 following auger flight 54 to further impell the drilling mud and the entrained tailings rearwardly, as illustrated by arrow 60. If desired, such auger flights may extend all the way to the trailing end of production casing 10.

In order to further insure that the drilling mud containing the entrained tailings is completely evacuated from the reamed pilot hole, suction may be provided at the trailing end of the production casing as illustrated in FIG. 4. A pack-box 70 is attached to the trailing end of production casing 10 to provide a seal between the production casing and washover pipe 28. A pump 72 communicates with the interior of production casing 10 through conduit 74. Pump 72 sucks the drilling mud containing the entrained tailings along the interior of casing 10, as illustrated by arrows 76, and out of the production casing.

Referring back to FIG. 2, it is apparent that the outer diameter of pack-off blade 50 is greater than the outer diameter of production casing 10. Accordingly, an annular void 78 will be left circumscribing the production casing. Void 78 will typically be filled with ground water to lubricate passage of production casing 10 along the path of the reamed pilot hole.

It may be desirable to inject a high lubricity fluid into void 78 to further facilitate the advancing of production casing 10 into the reamed pilot hole. Accordingly, a supply pipe 80 is mounted to the exterior of production casing 10, and extends from the trailing end illustrated in FIG. 4 to pack-off blade 50. A high lubricity fluid is injected into conduit 80 at the trailing end of production casing 10 to pack-off blade 50, in which it is distributed to and dispersed by a plurality of orifices 82, as illustrated in FIG. 3. The high lubricity fluid exiting orifices 82 serves to further lubricate the passage of production casing 10 into the pilot hole.

Operation

In operation, a pilot hole is initially drilled along an inverted underground arcuate path beneath the obstacle such as river 14 to be traversed. The pilot drill string 22 is left in the pilot hole. A washover casing 28 is then advanced and simultaneously rotated into and along the path of the pilot hole circumscribing pilot string 22. The reaming apparatus 36 attached to washover pipe 28 reams the pilot hole to a preselected diameter to accommodate the production casing.

Production casing 10 is advanced into and along the reamed pilot hole in following relationship to reaming apparatus 36. Pack-off blade 50 provides a seal between casing 10 and the sidewalls of the reamed pilot hole so that the drilling mud containing the cuttings from the reamer flows into the interior of the advancing casing. Auger 54 on rotating washover pipe 28 impells the drilling mud containing the entrained cuttings from the leading end of the production casing toward the trailing end thereof. Movement of the drilling mud containing the entrained tailings along production casing 10 is facilitated by the suction provided by pump 72 at the trailing end of the casing. In this manner, the drilling mud and the entrained tailings are substantially completely evacuated from the hole.

Complete evacuation of the drilling mud containing the entrained cuttings is desired so that the cuttings do not interfere with the progress of the production casing into the hole. In the present invention such cuttings will not enter the annular space surrounding the production casing and interfere with the advancing of the casing into the hole. Advancement of the production casing can be further enhanced by injecting a high lubricity fluid into the space circumscribing the production casing.

General Description of Alternate Embodiment

Figure 5:
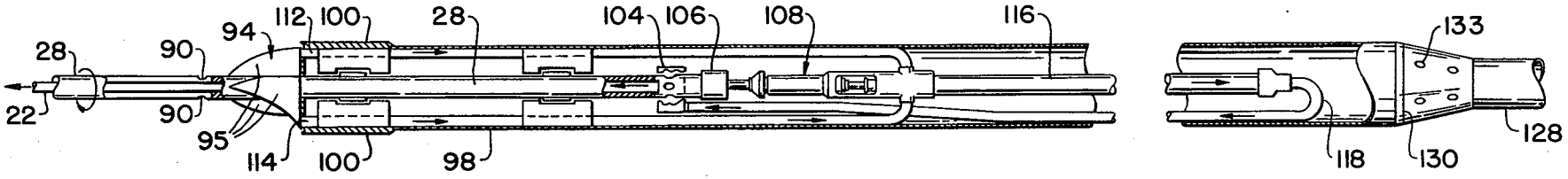
FIG. 5 is a view in partial section of a reaming apparatus driven by washover casing with the washover casing powering a positive displacement pump of the moineau variety to evacuate transport fluid and entrained cuttings from the path of a reamer.

Referring to FIG. 5 a pilot string 22 is shown having a washover pipe 28 concentrically threaded thereover. Washover shoe 28 is apertured in aperture 90 immediately in advance of a rotating reamer assembly 94.

Reamer assembly 94 consists of a plurality (here shown as 3 generally sail-shaped metallic reaming members 95). Members 95 are welded to the outside of the washover shoe 28 to rotate therewith. Washover shoe and pipe 28 extends interiorally of a pump casing 98. Pump casing 98 does not rotate. Instead casing 98 is advanced without rotation through the liquid-lubricated region immediately behind the reaming assembly.

Washover pipe 28 extends through a swivel coupling 104 to a regular coupling 106 which rotates a positive displacement pump of the moineau variety 108. Suitable moineau pumps are manufactured by Robbins and Meyers of Toledo, Ohio. The operation of moineau pump 108 can best be understood by explaining the fluid circuit in which it operates.

Pump casing 98, which is floating, is apertured immediately behind the reaming assembly 94 at a face of conduits 112 and 114. A drilling fluid (such as Driller's mud) is injected into the conduits 112 and 114, entrains the drilling cuttings and passes rearwardly to the intake side of the moineau pump 108. At the positive displacement pump 108, the fluid is pumped rearwardly in a conduit 116 to a reversing loop 118. At reversing loop 118 the fluid is connected back to the swivel 104. From the exterior of the pipe at swivel 104, exiting fluid is passed through the center of the drill string 22 to the pump 108 and out of the reaming region.

It thus can be seen that the rotating washover shoe or pipe 28 not only powers the reaming assembly 94 but effects a positive displacement evacuation of the drilling fluid and entrained cuttings from the vicinity of the reamer assembly 94.

It should be appreciated that the apparatus herein has numerous advantages over a simple auger flight. For example, a simple auger flight, unlike a positive displacement pump, can evacuate only the cuttings or tailings encountered by the auger blades along the reamed path of the enlarged pilot string.

Moreover, it will be appreciated that the enlarged floating pump casing 98 need only be the lead element to other assemblies.

Regarding float casing 98 and the trailing casing 128, it can be appreciated that by plugging the pipe at a barrier 130 and providing a series of apertures 133 in the bell between pipe 28 and floating casing 98 an annulus of high viscosity fluid may be left in the path of the floating casing 98. For example, where the conduit of the pilot hole exits on one side of an obstacle 14 and the production casing is being placed from the other side of the obstacle, the production casing can be used for the flowpath of a high viscosity field fluid to lubricate the passage of the production casing as it is crowded in a non-rotative manner into the ground.

While a preferred embodiment of the system and method of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

I claim:

1. Apparatus for emplacing a casing underground beneath an obstacle and between first and second ground level locations, said apparatus comprising means for placing a pilot string along an invert arcuate path beneath said obstacle between said ground level locations; a reaming apparatus for reaming an annulus about said pilot string to a preselected diameter; means for introducing a casing behind said reaming apparatus, the diameter of said casing being less than the reamed diameter, thereby to establish an annular void in the ground between the outer circumference of said casing and the inner circumference of the circumscribing ground; means for providing a substantially sealing contact between the outer surface of said casing and the inside surface of the circumscribing ground at a location between the reaming side and the annular void; means for introducing a transport fluid at said reaming site for entrained cuttings produced by said reaming apparatus; means for advancing said casing into and along said pilot string in following relation to said reaming apparatus; means for impelling said transport fluid and entrained cuttings into the interior of the leading portion of said casing; and positive displacement pump means located within the casing at the leading end thereof for evacuating the transport fluid and entrained cuttings from said reaming site in sealed-off relation to said annular void.

2. Apparatus as recited in claim 1, wherein said pilot string is hollow and further including means coupling the discharge of said pump to the interior of the pilot string for evacuating the transport fluid and entrained cuttings through the pilot string.

3. Apparatus as recited in claim 1, and additionally comprising a washover pipe including at least one aperture therein proximate said reaming apparatus, said washover pipe having an inner diameter greater than the outer diameter of said pilot string and an outer diameter less than the inner diameter of said casing; means for advancing and simultaneously rotating said washover pipe in circumscribing relation with said pilot string simultaneous with the advancement of said casing; means coupling the washover pipe to the drive of said pump, the housing of said pump being non-rotatable with respect to said casing; and an auger flight attached to the outer circumference of said washover pipe, whereby the transport fluid and entrained cuttings are withdrawn from said reaming site.

* * * * *